United States Patent [19]

Fitch et al.

[11] 4,197,182

[45] Apr. 8, 1980

[54] CATHODE ASSEMBLY FOR PLURAL CELL ELECTROLYZER

[75] Inventors: Robert H. Fitch, Syracuse; Bruce E. Kurtz, Marcellus, both of N.Y.

[73] Assignee: Allied Chemical Corporation, Morris Township, Morris County, N.J.

[21] Appl. No.: 974,646

[22] Filed: Dec. 29, 1978

[51] Int. Cl.[2] ..... C25B 9/00

[52] U.S. Cl. ..... 204/284; 204/286; 204/254; 204/255; 204/256

[58] Field of Search ..... 204/254–256, 204/284, 286

[56] References Cited

U.S. PATENT DOCUMENTS

| | | | |
|---|---|---|---|
| 2,522,661 | 9/1950 | Bowen | 204/256 |
| 2,682,505 | 6/1954 | Greco | 204/256 |

*Primary Examiner*—R. L. Andrews

*Attorney, Agent, or Firm*—James Riesenfeld; Ernest A. Polin

[57] ABSTRACT

A cathode assembly for a plural cell electrolyzer is provided which comprises a rigid cathode support joined to a cathode by a first set of connecting members and to an anode in an adjacent cell by a second set of connecting members. The cathode support and first set of connectors enable the cathode to maintain an essentially flat surface. The support and second set of connectors stabilize the cell frame and enable the anode likewise to maintain a flat surface. Thus, the electrodes in a cell may be set accurately flat and parallel to minimize the interelectrode gap and the cell voltage drop due to the electrolyte path, and, consequently, to improve cell efficiency.

7 Claims, 5 Drawing Figures

CATHODE ASSEMBLY FOR PLURAL CELL ELECTROLYZER

BACKGROUND OF THE INVENTION

1. Field of the Invention

This invention relates to a design for an electrode assembly for a plural cell electrolyzer and more particularly to a design which provides a cathode with an essentially flat surface for use in the electrolysis of brine for production of chlorine and caustic soda.

2. Description of the Prior Art

The electrolysis of sodium chloride brine is by far the most important commercial process for producing chlorine and caustic soda. Recently, there has been tremendous commercial interest in electrolysis cells incorporating metallic anodes rather than graphite anodes used theretofore in this process. Further, there is evolving a clear trend toward the use of cationic permselective membranes rather than conventional permeable deposited asbestos diaphragms in these cells. The permselective membranes differ substantially from the permeable diaphragms in that no hydraulic flow from anode to cathode compartments is permitted. The permselective membranes, typically ion exchange resins cast in the form of very thin sheet, consist of a perfluorinated organic polymer matrix to which ionogenic sulfonate groups are attached. Thus, during electrolysis of sodium chloride brine the negatively charged groups permit transference of current-carrying sodium ions across the membrane while excluding chloride ions. Consequently, it is not possible to produce caustic soda of a predetermined concentration and nearly free of chloride within the cathode compartment.

Maximum utility of a system incorporating metallic anodes and permselective membranes is achieved by a multicell design wherein cells are arranged in serial fashion. An anode mounted on one cell frame faces the cathode mounted on the adjoining cell frame. Between the two cell frames is interposed a cationic permselective membrane. In a configuration such as this, it is important to have the paired anode and cathode parallel to each other. This permits one to minimize the interelectrode gap and the cell voltage drop due to the fluid paths in the cathode and anode chambers.

U.S. Pat. No. 4,115,236 discloses an intercell connector which provides direct electrical communication and secure mechanical connection between cells of an electrolyzer. Although that device provides a significant advance over the prior art, it involves joining adjacent electrodes with four connectors, each mating with a separate cathode boss. Using that design, it may be difficult to produce a cathode with a flat surface, since this in effect requires that the four boss surfaces be coplanar. Also, unless the cathode boss surfaces are coplanar, when the interelectrode connections are made, distorting forces are transmitted to the cell frame and/or to the anode bosses. These forces can cause loss of flatness in the anode.

SUMMARY OF THE INVENTION

To overcome the aforementioned deficiencies in prior art cathode assemblies, the present invention comprises a cathode comprising a substantially rectangular foraminous plate in a first cell; a rigid cathode support disposed substantially parallel to said cathode and comprising a substantially rectangular metal plate having length and width dimensions no greater than the corresponding dimensions of said cathode and a perimeter which covers at least about 10% of the area of said cathode; first electrically conductive members connecting the perimeter of said support to said cathode, and second electrically conductive members connecting said cathode support to an anode in an adjacent cell.

The frame of the electrolyzer of this invention involves a central plastic webbing which divides the electrolyzer into cells. On one side of a webbing element is the cathode of one cell; on the other side, the anode of the adjoining cell. Between the cathode and webbing is the cathode support, whose perimeter is joined to the cathode with the first set of connectors. The support is joined to the anode by four of the second, or intercell, connectors, which extend through the webbing into four anode bosses, which in turn are attached to the anode by, e.g., welding. A single cell includes an anode from one webbing element facing a cathode on another webbing element. Between these two electrodes is interposed a cation permselective membrane. It is important to have the anode and cathode planar and parallel to each other, so that the interelectrode gap can be set accurately, thus minimizing the catholyte/anolyte electrical path voltage drop and consequently maximizing cell efficiency.

The single rigid cathode support of this invention provides a unitized boss surface to serve as an anchoring member for the cathode. When the cathode is joined to the support with the first connecting members, the cathode surface can readily achieve acceptable flatness. In addition, the cathode support serves to stabilize the cell frame by its intrinsic rigidity and provides a non-distorting member upon which to support the anode by way of the intercell connectors. By producing a cathode structure which mechanically stabilizes the cathode/cell frame/anode, ture parallelism of the two electrode surfaces may be achieved.

BRIEF DESCRIPTION OF THE DRAWINGS

The invention will be better understood and additional advantages will become apparent when reference is made to the following description and accompanying drawings in which.

DESCRIPTION OF THE PREFERRED EMBODIMENT

The cathode assembly of the present invention is designed for use in conjunction with a plural cell, bipolar permselective membrane electrolyzer. The cathode assembly is especially adapted for use in an electrolyzer which receives an input of alkali metal halide brine for the conversion thereof to halogen and alkali metal hydroxide. In practice, the alkali metal is generally either sodium or potassium and the halide is chloride. Accordingly the components are chosen, from a design and material viewpoint, with these highly corrosive environments in mind.

Figure 1:
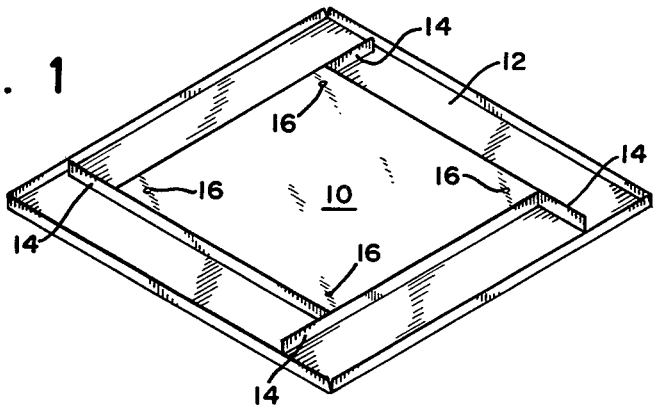
FIG. 1 is an isometric view of a cathode assembly of this invention.

Referring to the drawings in more detail, FIG. 1 shows a rigid cathode support 10 joined to cathode 12 by connecting members 14. The materials from which the cathode support, cathode, and connecting members are fabricated should be electrically conductive and resistant particularly to hydroxyl ions. Typically, these elements of the cathode assembly are fashioned from metal selected from the group consisting of iron, steel, cobalt, nickel, manganese and the like, iron and steel being preferred. Although it is not essential that the elements all be fabricated from the same metal, some corrosion problems can be avoided by doing so. The cathode must be of foraminous material to allow free circulation of catholyte between the front and back surfaces of the cathode. The connecting members serve both to ensure that the cathode maintains a flat surface and to provide electrical communication between cathode and support. The connectors must be of foraminous material to permit the hydrogen evolved on the cathode to rise to the surface of the catholyte. The foraminous material of the cathode and connectors may be expanded metal or, preferably, perforated metal sheet. Most preferably, these elements comprise perforated low-carbon steel sheets. Instead of sheet, the connectors may alternatively be either angle or channel.

The primary purpose of the cathode support is to ensure that the paired anode/cathode elements are parallel. To accomplish this purpose, the support must be rigid and have an accurately flat face. Adequate rigidity may be achieved with a support area about 10% of the cathode area; however, preferably the support area covers at least about 25% of the cathode area. The support should comprise a metal plate at least about 4.5 mm thick. Precision surface grinding of the support faces is the preferred method for achieving the required flat face.

Figure 2:
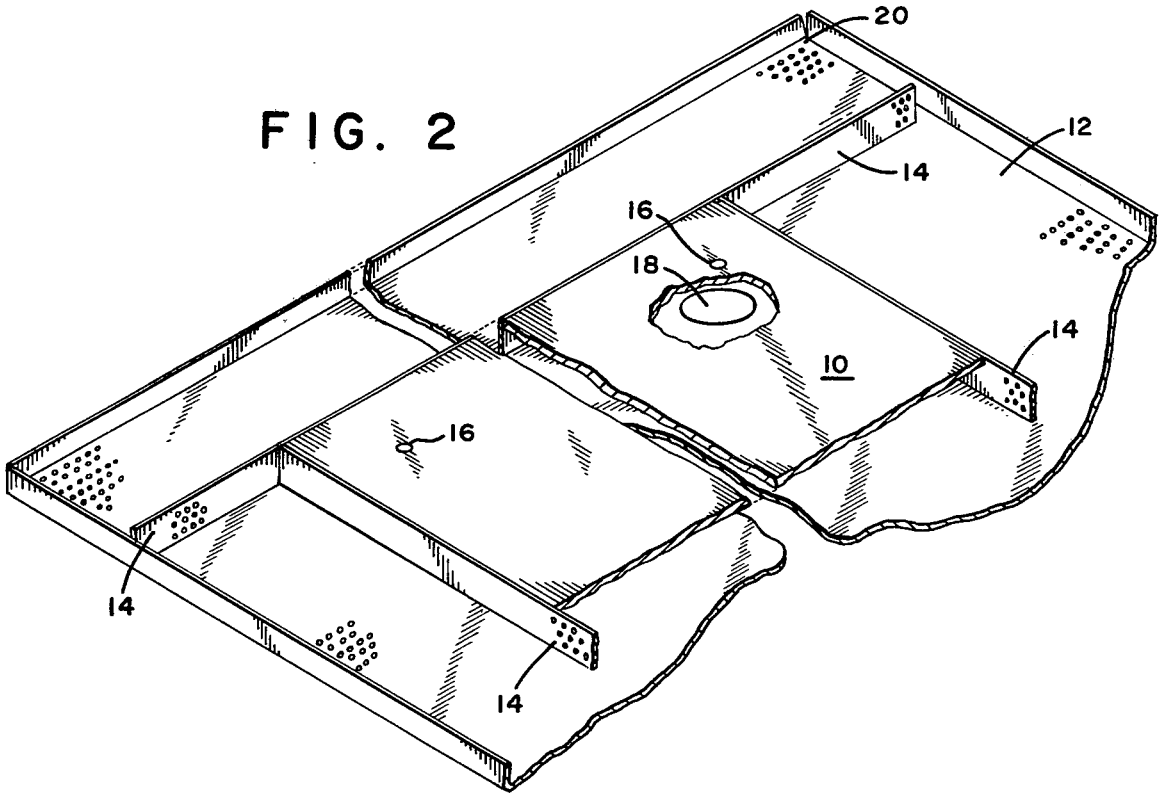
FIG. 2 is an enlarged cutaway isometric view of the assembly of FIG. 1.

FIG. 2 shows the elements of the cathode assembly in greater detail, including through bores 16 in the cathode support through which the intercell connectors join the cathode support to the anode in an adjacent cell. Through bores 18 in the cathode provide access to the heads of the intercell connectors. To ensure a smooth edge for the holes 18 there are no perforations punched in the cathode on the perimeter of said holes. In the preferred embodiment, the cathode 12 is cut at the corners and folded at about 90° angle around the edges 20 to assist in achieving flatness after the punching step. Where reference is made herein to the flat surface of the cathode and to the requirement that anode and cathode surfaces be parallel, these folded edges are obviously excluded.

Figure 3:
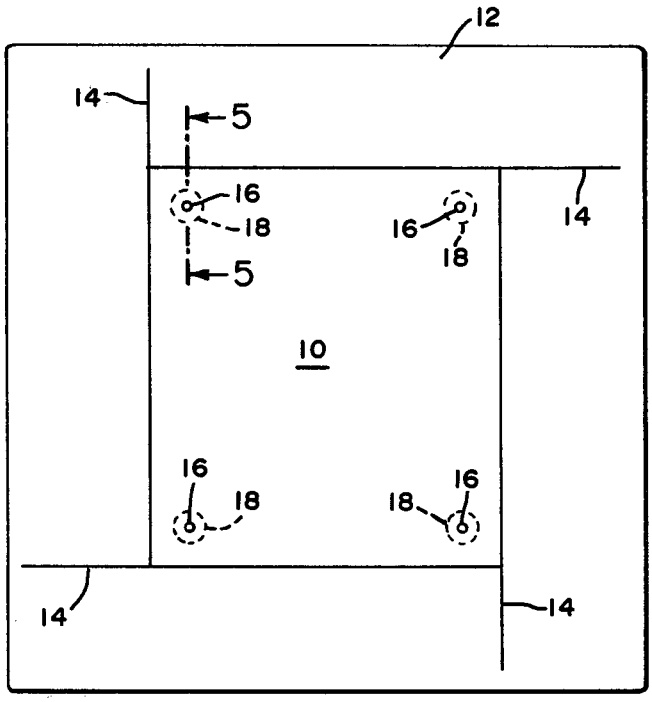
FIG. 3 is an elevation view of the assembly of FIG. 1.
Figure 4:
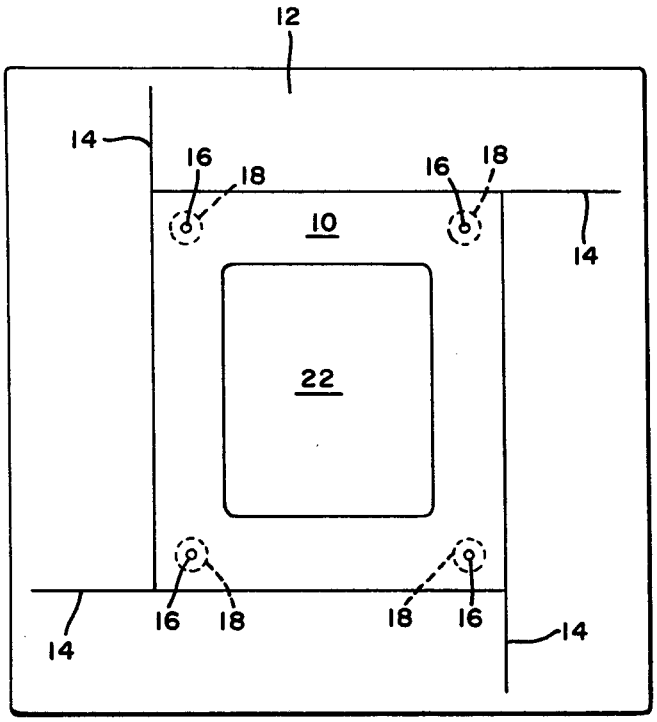
FIG. 4 is an elevation view of an alternative embodiment of a cathode assembly of the invention.

FIGS. 3 and 4 show elevation views of alternative embodiments of the cathode assembly. Preferably, as shown in the Figures, the center of cathode support 10 is positioned substantially over the center of cathode 12, with the two elements having the same orientation, i.e., the edges of the cathode are parallel to the corresponding edges of the support. FIG. 4 shows the preferred embodiment of the cathode support of this invention, in which a substantially rectangular cutout 22 yields a picture frame configuration. The center of the cutout substantially coincides with the center of the support, and the cutout and support have substantially the same orientation. The primary advantage of the cutout is a substantial weight reduction. The cutout must, however, not be so large that the support lacks rigidity; thus the area of the cutout must be no greater than about 50% of the area enclosed by the outer perimeter of the support.

Figure 5:
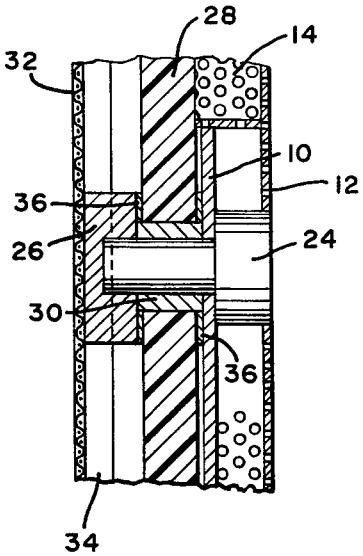
FIG. 5 is a sectional view taken substantially along the line 5—5 of FIG. 3 showing, in addition, the intercell connector, cell frame, and anode structures.

FIG. 5 shows intercell connector 24 joining cathode support 10 to anode boss 26 through cell frame webbing element 28. Electrically conductive insert 30 mates against the accurately flat surfaces of the cathode support and anode boss. Because the anode 32 is conventionally a mesh structure, electrically conductive rods 34 are included to assist in distributing electrical current throughout the mesh and rigidify the anode. Tightening connector 24 compresses gaskets 36 to ensure a fluid and gas tight connection. Additional details concerning the intercell connector are disclosed in U.S. Pat. No. 4,115,236, which is incorporated herein by reference. In the resultant structure the cathode 12 and anode 32 are accurately flat and parallel both to each other and to electrodes mounted on adjoining cell frames.

We claim:

1. A cathode assembly for use in a plural cell bipolar permselective membrane electrolyzer comprising:

(a) a cathode comprising a substantially rectangular foraminous metal plate in a first cell, (b) a rigid cathode support disposed substantially parallel to said cathode and comprising a substantially rectangular metal plate having length and width dimensions no greater than the corresponding dimensions of said cathode and a perimeter which covers at least about 10% of the area of said cathode, (c) first electrically conductive members connecting the perimeter of said support to said cathode, and (d) second electrically conductive members connecting said support to an anode in an adjacent cell.

2. A cathode assembly according to claim 1 wherein said rigid cathode support has a substantially rectangular cutout, yielding a picture frame configuration.

3. A cathode assembly according to claim 2 wherein the center of said cutout substantially coincides with the center of said cathode support and said cutout and cathode support have substantially the same orientation.

4. A cathode assembly according to claim 1 wherein said cathode comprises a substantially rectangular perforated low-carbon steel sheet.

5. A cathode assembly according to claim 1 wherein the perimeter of said rigid cathode support covers at least about 25% of the area of said cathode.

6. A cathode assembly according to claim 1 wherein the center of cathode support is positioned substantially over the center of said cathode and said cathode support and said cathode have substantially the same orientation.

7. A cathode assembly according to claim 1 wherein said first electrically conductive members comprise perforated low-carbon steel sheets, whose planes are substantially perpendicular to the planes of both the cathode and the cathode support.

* * * * *